US010124204B1

(12) United States Patent
Vo et al.

(10) Patent No.: US 10,124,204 B1
(45) Date of Patent: Nov. 13, 2018

(54) POWER RINGS

(71) Applicants: Henry Nguyen Vo, Edmond, OK (US); Adam Abbo, Oklahoma City, OK (US)

(72) Inventors: Henry Nguyen Vo, Edmond, OK (US); Adam Abbo, Oklahoma City, OK (US)

(73) Assignee: New Tech World, LLC, Edmond, OK (US)

( * ) Notice: Subject to any disclaimer, the term of this patent is extended or adjusted under 35 U.S.C. 154(b) by 0 days.

(21) Appl. No.: 14/458,015

(22) Filed: Aug. 12, 2014

(51) Int. Cl.
*A63B 21/02* (2006.01)
*A63B 21/04* (2006.01)
*A63B 21/055* (2006.01)

(52) U.S. Cl.
CPC ..... *A63B 21/0407* (2013.01); *A63B 21/0555* (2013.01)

(58) Field of Classification Search
CPC ..... A63B 21/04; A63B 23/16; A63B 21/02; A63B 21/0609; A63B 21/00043; A63B 21/05–21/0557; A44C 11/00; A44C 15/00; A44C 15/001; A44C 5/02; A44C 5/107
USPC ..... 63/15.3; D11/12
See application file for complete search history.

(56) References Cited

U.S. PATENT DOCUMENTS 3,966,204 A * 6/1976 Dubach ..... 482/93
5,158,520 A 10/1992 Lemke et al.
5,569,136 A * 10/1996 Holten ..... 482/126
5,624,359 A * 4/1997 Dean ..... 482/91
D416,594 S * 11/1999 Sardina ..... D21/684
6,059,698 A 5/2000 Mazor
6,071,218 A * 6/2000 Tepperberg ..... 482/121
6,220,994 B1 * 4/2001 Rich ..... 482/123
6,368,255 B1 * 4/2002 Chan-Rouse ..... 482/91
D599,419 S * 9/2009 Chiuchiarelli ..... D21/686
7,678,033 B2 3/2010 Tyree
7,695,413 B1 4/2010 Cruz et al.
7,743,656 B1 * 6/2010 Dickinson et al. ..... 73/379.01
8,033,966 B2 10/2011 Ayoub
D729,888 S * 5/2015 Kessler ..... D21/692
2006/0052220 A1 * 3/2006 Jackson et al. ..... 482/52
2006/0084556 A1 * 4/2006 Payne ..... 482/121
2007/0207903 A1 * 9/2007 Csabai ..... 482/121
2009/0156374 A1 * 6/2009 Miyahira ..... A63B 21/06 482/106
2011/0028287 A1 * 2/2011 Kassel ..... 482/121
2011/0237410 A1 9/2011 Perez
2012/0077646 A1 3/2012 Hetrick
2013/0079202 A1 3/2013 Librizzi
(Continued)

*Primary Examiner* — Nyca T Nguyen
(74) *Attorney, Agent, or Firm* — Hall Estill Attorneys at Law

(57) ABSTRACT

A power flex ring system having a plurality of rings of semi-rigid elastomeric material, each ring having an initial shape, the plurality of rings interconnected to form a ring chain. A user handle is adapted for connection to a selected one of the rings to form a first chain end. A securement mechanism is adapted to connect to a selected one of the remaining rings to form a second chain end and to secure the second chain end to a fixed structure, wherein the handle, the chain and the securement mechanism are structurally configured to facilitate an exercise motion by a user exerting a force via the handle to deform the plurality of rings from their initial shapes. Each of the plurality of rings has a selected tensile strength and a different color indicating the tensile strength of the rings.

25 Claims, 10 Drawing Sheets

(56) References Cited

U.S. PATENT DOCUMENTS

2013/0331242 A1* 12/2013 Wilson ..... 482/126
2014/0305093 A1* 10/2014 Nevatia ..... A44C 27/00
59/35.1

* cited by examiner

POWER RINGS

BACKGROUND OF THE INVENTION

1. Field of Invention

The present invention relates to the field of exercise equipment, and more particularly but not by way of limitation, to a power flex ring system.

2. Discussion

People today generally have an understanding that their health depends on proper nutrition and bodily exercise on a regular basis. Health clubs have arisen over the past several years that provide an individual access to many exercise machines for physical exercise work-outs.

While numerous exercise apparatuses are found in institutional facilities, a common resistance band has become a leading exercise device used by personal trainers and physical therapists in working with individuals to develop their personal muscular frame. This simple device is available at low cost and the use thereof has been found to offer broad fitness in therapeutic applications. Thus, resistance bands have achieved wide acceptance among fitness and therapeutic professionals and have become a standard piece of exercise equipment found in virtually every aspect of the fitness and therapeutic industries.

While exercise resistance bands have been the object of numerous design adaptations, there yet remains a need for a resistance band apparatus that provides the capability of doing numerous exercise routines for both the beginner and the more athletically developed individual, as presented by the present invention.

SUMMARY OF THE INVENTION

The present application provides a power flex ring system, in one preferred, has a plurality of rings of semi-rigid elastomeric material, each ring having an initial shape, the plurality of rings interconnected to form a ring chain having opposing first and second chain ends. A user handle is adapted to be connected to the first chain end. A securement mechanism is adapted to connect to the second chain end to secure the ring chain to a fixed structure, wherein the handle, the chain and the securement mechanism are structurally configured to facilitate an exercise motion by a user exerting a force via the handle to deform the plurality of rings from their initial shapes.

In one embodiment, each of the plurality of rings has a selected tensile strength and a different color signifying the tensile strength.

The advantages, features and objects of the present invention will be apparent from the following description when read in conjunction with the accompanying drawings and appended claims.

BRIEF DESCRIPTION OF THE DRAWINGS

FIG. 8 depicts an endless ring member that is homogenous throughout, while

DESCRIPTION

As noted herein above, an exercise resistance band provides the user the ability to exercise using a resistive load (force) without the requirement of heavy weights. A resistance exercise band is typically stretched between two points to simulate dead weight resistance. Resistance bands of various designs are used across the complete spectrum of exercises to do curls, bench pressing, butterflies, leg presses and many other exercises.

Resistance bands are especially useful for those who travel and desire to maintain their exercise routine. Such bands are typically inexpensive and of minimal weight and thus readily transportable for one's travel convenience. And the use of such devices offers one the ability to exercise at any convenient location, such as at one's home or office, or hotel room when traveling, and one using resistance bands can avoid the cost and travel required by a gym membership.

The elastic ring bands of the present invention are preferably tubular with a cylindrical cross section having a hollow or solid center section, and a variety of tensile strength resistive ranges; various cross sections are offered having varying outer diameters, wall thickness and inner diameters with differing elastic durometer values. Such ring bands generate a non-linear resistive force that changes as the band is elongated. The resulting force-distance curve of a ring band provides a work feel not available from exercising with free weights. In sum, presented herein is an exercise system having a plurality of flexible rings of variable strengths to stretch, each of the rings having the same nominal overall diameter, the same nominal cross-sectional diameter, a different resistance to deformation, and a different durometer value. The flexible rings are provided with a plurality of connectors interconnecting the flexible rings by pairs so that the flexible rings can be paired as desirable to provide a selective range of force necessary to stretch the rings.

Figure 1:
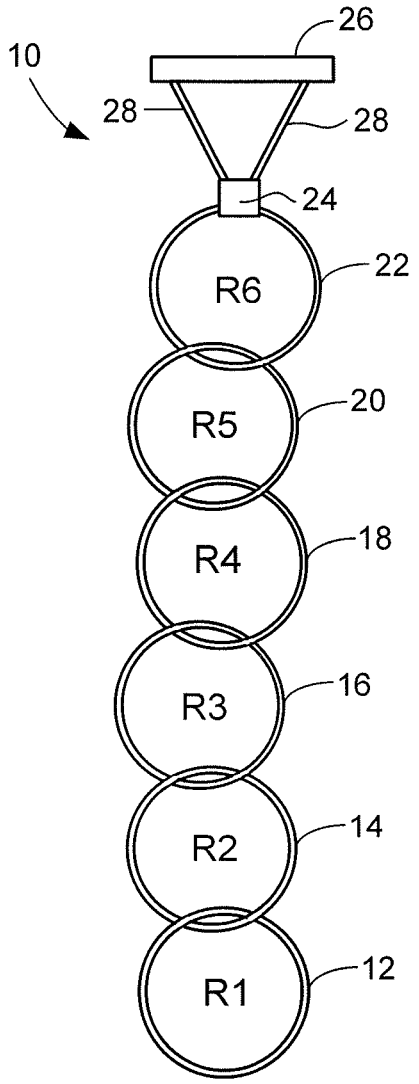
FIG. 1 is an embodiment of a preferred embodiment constructed in accordance with the present invention in which an exercise device having a plurality of inter-looped elastic band ring members form a stretchable power flex ring device is shown.
Figure 2:
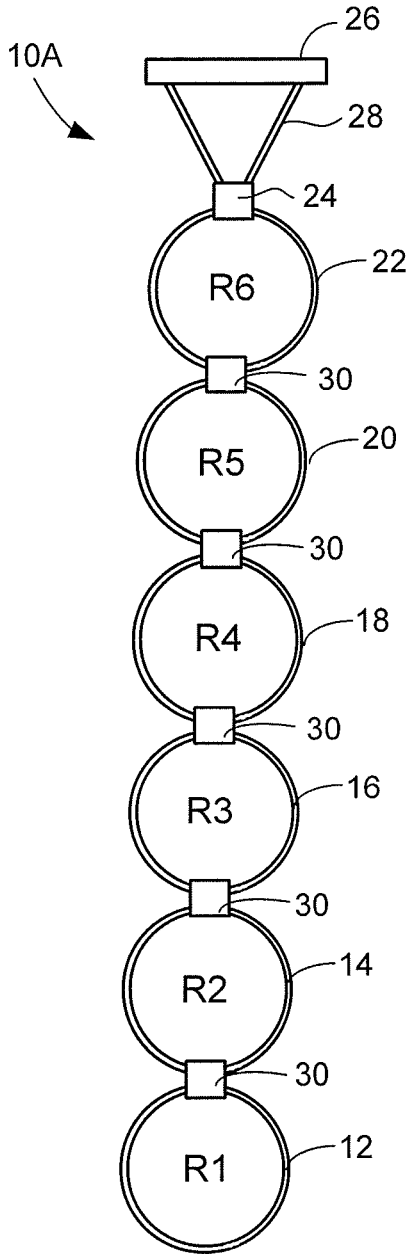
FIG. 2 is another embodiment of the present invention similar to FIG. 1 except the elastic band ring members are interconnected by connectors to form a stretchable power flex ring device.

Turning to the accompanying drawings and more particularly to FIGS. 1 and 2, shown therein are preferred embodiments constructed in accordance with the present invention, to wit, an exercise system having resistance bands formed from solid or hollow rings of flexible material and interlinked to form a chain-like structure.

More specifically, a preferred embodiment of the present invention is shown in FIG. 1 as an exercise system 10 that has six flexible rings designated 12 (R1); 14 (R2); 16 (R3); 18 (R4); 20 (R5); and 22 (R6). While six flexible rings are depicted in this figure, it will be understood that the present invention is not limited to a set number of such rings. The flexible rings are inter-looped connected to form a ring chain, and a connector 24 connects a handle member 26 via straps 28 to the ring 22 (R6).

FIG. 2 shows a similar ring chain 10A that is identical to the ring chain 10 of FIG. 1 with the exception that the six flexible rings, instead of being inter-looped, are inter-connected by connectors 30. Each of the connector 24 and 30 of these embodiments preferably comprises an endless strap loop through which straps 28 (FIG. 1) or adjacent rings pass (FIG. 2) with sufficient space to allow the connected rings to pivot freely, such as when the exercise system 10A is folded for storage, a mode which will be discussed further herein below. The connectors 24 and 30 can be adjustable loops of Velcro secured folded canvas strips or the like. Alternately, they can be formed by securing canvas strips folded into loops and secured together by a suitable adhesive or by mechanical bonding thereof, such as by riveting same; and while the endless strap loop as described generally performs satisfactorily, other loop connectors are described herein below. While the connectors 24 in FIG. 1 is shown connecting the handle 26 to the proximal end of the exercise ring chain, a unique feature of the present invention is that the exercise ring chain can be shortened or lengthened at will by merely connecting the handle 26 to any one of the ring members to make the attached ring the proximal end of the chain.

Figure 3:
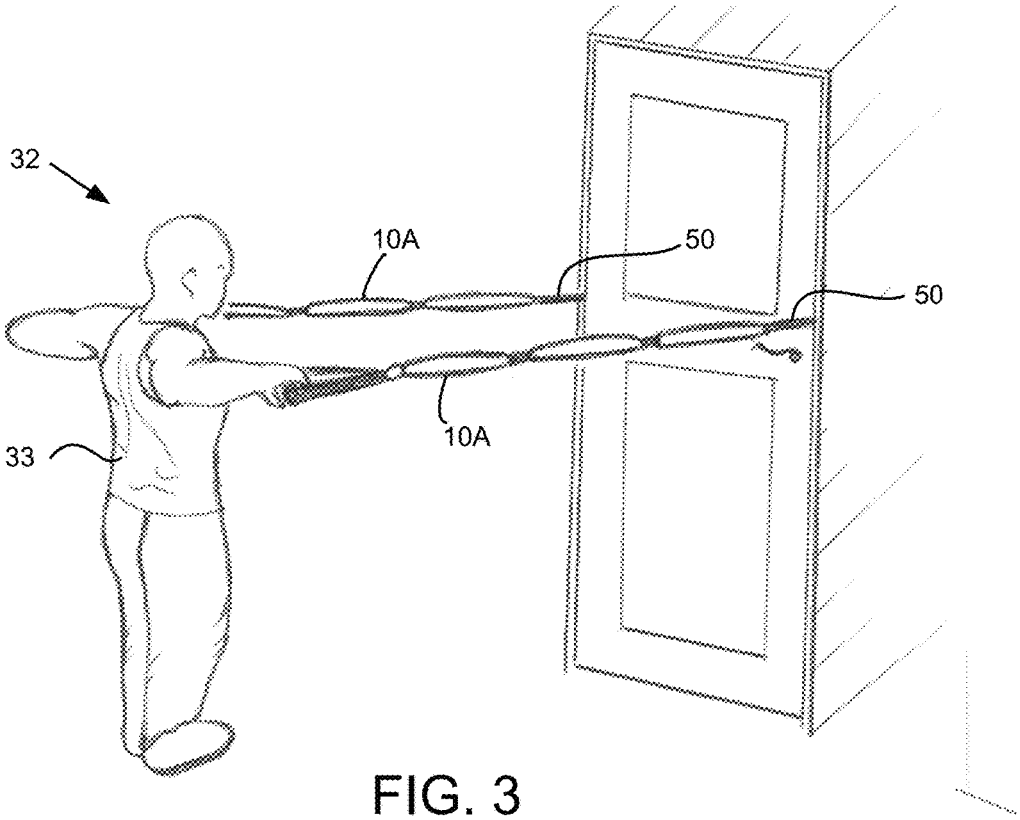
FIG. 3 is a perspective view of a person exercising with a pair power flex ring devices constructed in accordance with the present invention and anchored to a building door to perform an exercise for strengthening chest, shoulders and arms.
Figure 4:
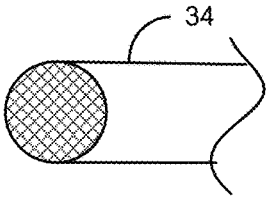
FIGS. 4 and 5 are cross sectional views of the ring members of FIGS. 1 and 2 depicting a homogeneous solid core and a hollow core, respectively.
Figure 5:
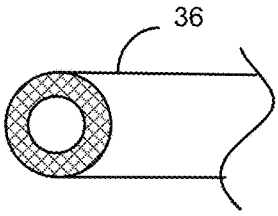

FIG. 3 illustrates a person an exercise routine 32 (row for rear deltoids and strengthening of chest, shoulder and arms) with a person 33 using a pair of the ring chains 10A having the distal end of the chain anchored to a doorway in a manner described herein below. Each of the rings 12 is made of latex rubber or other similar material having variable durometer values from R1 through R6 (available in different colors that depict the strength of the rubber), and as described below, has different torque as such is available from several manufacturers. The rings 12 can be a solid cored ring 34 of FIG. 4 or a hollow cored ring 36 of FIG. 5. The six ring chain concept is designed to transfer torque from one ring to another, which increases the life or the product.

Preferable strengths and colors of the rings R1 through R6 are as stated in the following Table 1:

TABLE 1

| Ring | Color | Force Range |
|---|---|---|
| R6 | Red | 30-35 |
| R5 | Orange | 25-30 |
| R4 | Purple | 20-25 |
| R3 | Blue | 15-20 |
| R2 | Green | 10-15 |
| R1 | Yellow | 5-10 |

Continuing with the exercise systems 10, 10A of FIG. 1, each has a handle member 26 that is connected by one or more straps 28 connected to one of the connectors 24, preferably at the end ring 22 as shown. With the fixture members describe herein below, the handle can be affixed to one or more of the rings, and an attachment member (not shown) can be affixed to the opposing end of the chain to secure the chain to a rigid support such as a floor plate, a door, etc.

Figure 6:
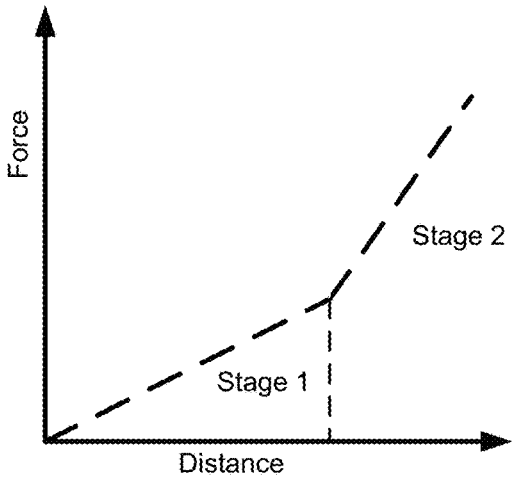
FIG. 6 is a graph of force applied to the devices of FIGS. 1, 2 versus stretch distance, the graph showing the increasing force required in stage 2 beyond that of stage 1 following a break over point.
Figure 7A:
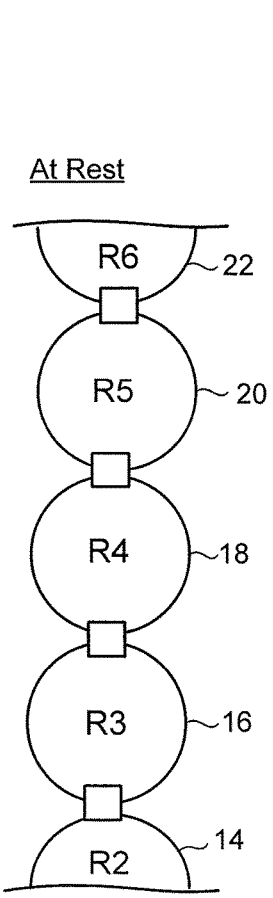
FIGS. 7A through 7C are diagrammatical depictions of a portion of the power flex ring device of FIG. 2 depicting, respectively, at rest; in stage 1 in which the device is partially stretched; and in stage 2 in which the device is further stretched beyond the turnover point.
Figure 7B:
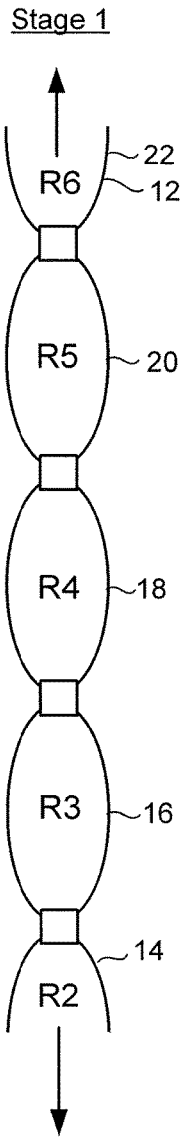

Unlike floppy resistance bands that can be deflected from an initial shape with substantially no force (as for example a rubber band), the rings in this disclosure take an initial shape and require some amount of force to stretch. As the rings are progressively further extended, the rings continue to stretch. This provides an increase in the amount of resistance force once the rings continue to be stretched between stages, as will be discussed below. Unlike conventional ring exercisers, the rings of the present invention provide resistance to deformation from an initial shape to a final elongated shape. This is illustrated diagrammatically in FIGS. 7A-7C:

FIG. 7A depicts the shape of the rings at rest;

FIG. 7B depicts these same rings stretched along the curve of stage 1 of FIG. 6;

and

Figure 7C:
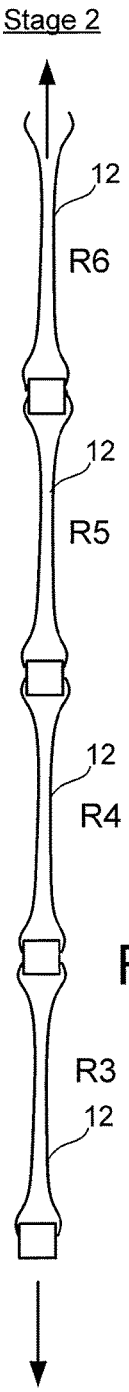

FIG. 7C depicts the ring deformation beyond stage 1 and along the stage 2 curve of FIG. 6.

Figure 8:
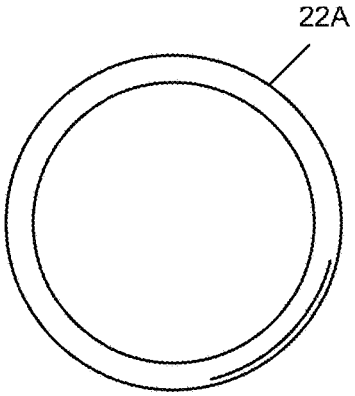
Figure 9:
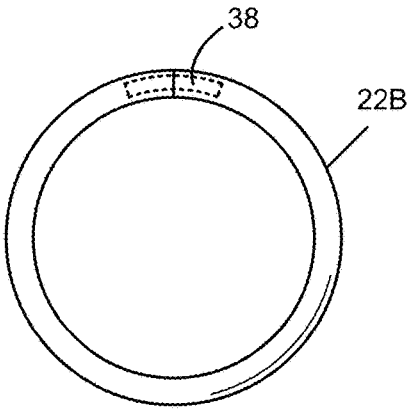
FIG. 9 depicts a length of a hollow core ring member that is made circular in shape by the insertion of an inner solid plug member that is inserted into opposite ends thereof.
Figure 10:
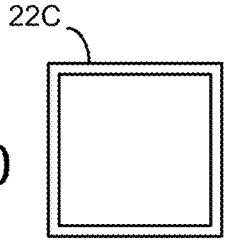
FIGS. 10 through 12 show alternative embodiments of the ring members having various shapes of a rectangle, oval and octagonal (shown with cross members), respectively.
Figure 11:
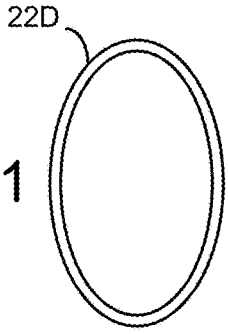
Figure 12:
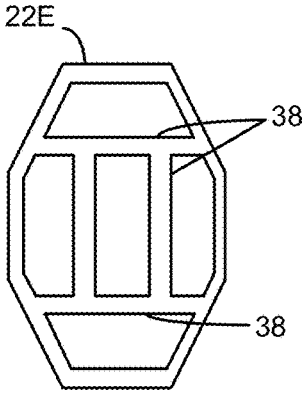

The rings of the present invention can be made in various shapes, such as illustrated by the ring shapes depicted in FIGS. 8 through 12:

1. FIG. 8—the ring 22A (representing all rings 12-22) is of unitary construction (tubular rubber can be joined end to end by applying thermal energy);
2. FIG. 9—the ring 22B is identical to ring 22A with the exception that it is constructed of a tube joined end to end by an inner member 38 that as an outer diameter that is disposable by force into the ends of the ring;
3. FIG. 10—the ring 22C is square or rectangular in configuration;
4. FIG. 11—the ring 22D is oval in configuration; and
5. FIG. 12—the ring 22E is octagonal in outer shape or configuration having several cross-members 38.

Figure 13:
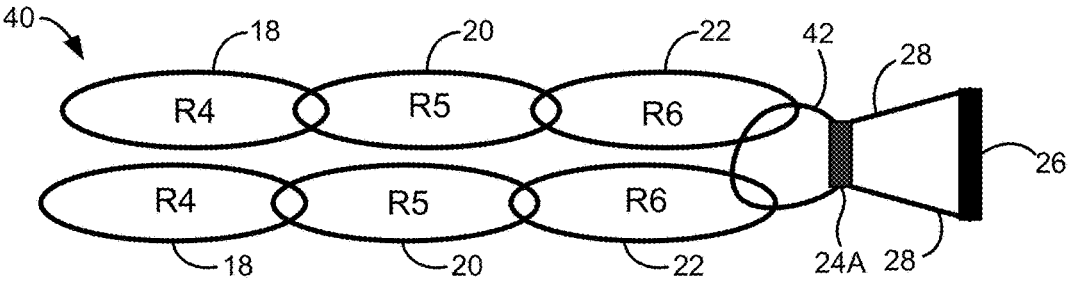
FIG. 13 shows an embodiment similar to that of FIG. 1 except having a hand member that connects to a pair of sets of ring members inter connected to a hand member as depicted, each set of ring members connected to the hand member.

Turning now to FIG. 13, shown therein is another preferred embodiment of a power exercise system 40 having parallel ring chains made up of rings 18, 20 and 22 on each ring chain and a handle member 26 connected by straps 28 to a lengthened connector 24A, which in turn is connected to a loop connector 42 that passed\s through the rings at the proximal ends of the parallel chains. The strengths the rings are labeled R4 through R6 and are shown in Table 1 above. While the number of rings is shown in FIG. 13 as three in each chain, the number can be that desired, as can which strength rings are selected. The power exercise system 40 can be used by a person as shown in FIG. 3 by anchoring the distal end rings as shown for the exercise system 10A.

Figure 14:
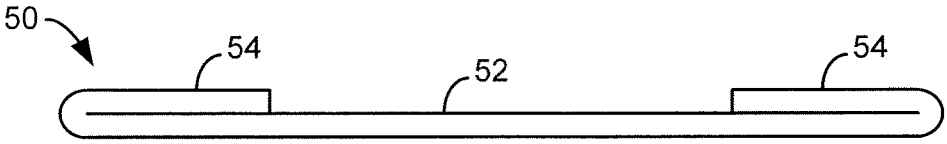
FIG. 14 shows a side view of a strap that is constructed to loop through an end ring of a ring chain such as the power flex ring devices of FIG. 1 or 2 for securing end ring to a door frame as shown in following figures.

Shown in FIG. 14 is an anchor strap 50 (also sometimes referred to as a securement mechanism) that has a body 52 with ends 54 that consists of folded portions of the body member 52. The folded anchor end portions 54 are secured to the body portion 52 preferably by an adhesive and by rivets (not shown), thereby permanently doubling the thickness of the anchor strap at the end portions 54. The length of the anchor strap can be varied, but will normally be of such length as to be folded to pass through the distil end rings of a ring chain such as those of the exercise system 10A of FIG. 3. More explicitly, while the door 56 is opened, one of the anchors strap 50 is folded end to end with the end portions 54 back to back with the medial portion extending through the distil end ring of a ring chain and the double ends placed in the space between the door 56 and its door frame. This is repeated with another anchor strap 50 for the other distil end ring for the parallel ring chain to anchor the distil end rings of the exercise system 10A as depicted in FIG. 3.

Figure 16:
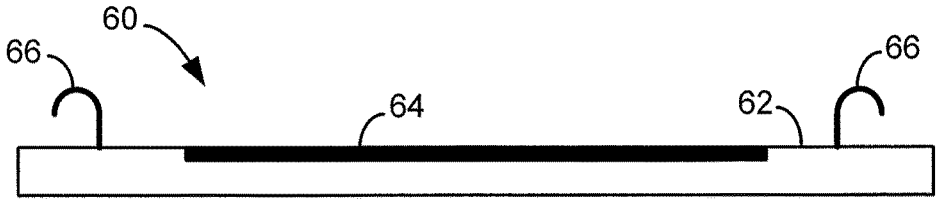
FIG. 16 is a side view of the platform of FIG. 15.
Figure 15:
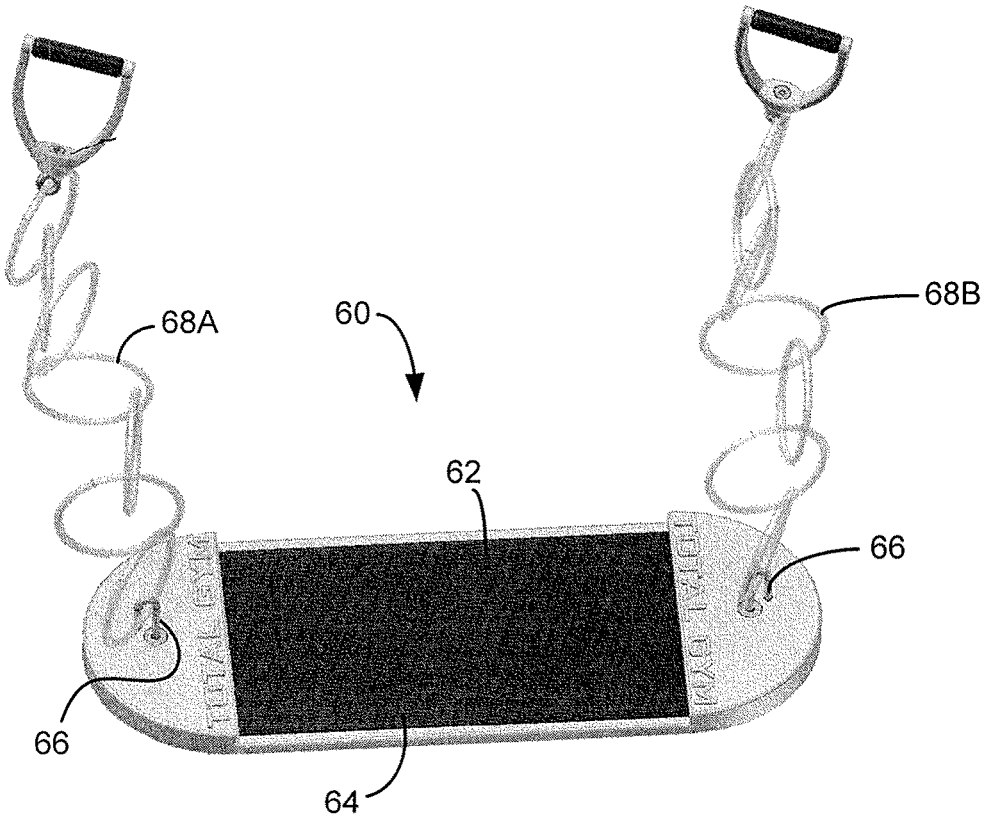
FIG. 15 shows a step platform with hooks to which a pair of stretchable power ring chains can be connected.

FIGS. 15 and 16 show an exercise system 60 having a stand-on platform 62. The platform 62 has a medial portion that preferably is a rubberized, non-slip surface 64. A pair of hooks 66 extends upwardly from the surface 64 at opposing ends of the platform 62. A selected one of the rings of a first flexible ring chain 68A can be engaged with the hook 66 on one end of the platform 62 and a second flexible chain 68B in like manner can be engaged with the hook 66 on the opposite end of the platform 62. It will be understood that the flexible chains 68A and 68B are constructed in the same manner as the exercise system 10 of FIG. 1 with as many flexible rings as desired. In use, a person can stand or kneel on the platform 62 to exercise.

Figure 17:
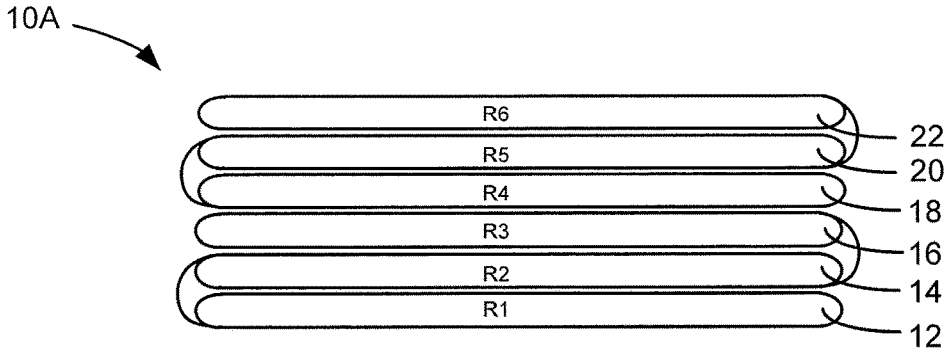
FIG. 17 illustrates the power flex ring device of FIG. 2 stacked substantially flat as for packaging and shipping.

A feature of the embodiments of the present invention is the folding profile of the ring chains, such as the exercise system 10*a* shown in FIG. 17. The rings 12 through 22 lay flat on a horizontal surface and the handle 26 (not shown) folds into the hollow of the stacked rings, provided the dimension of the handle 26 is sized appropriately.

Figure 18:
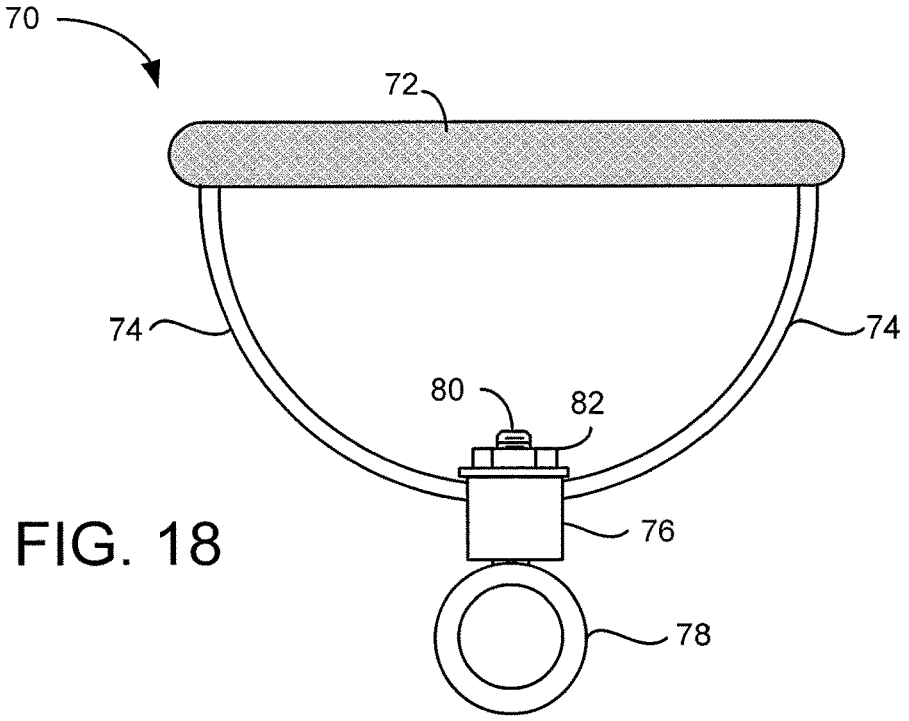
FIG. 18 shows a handle assembly.
Figure 19:
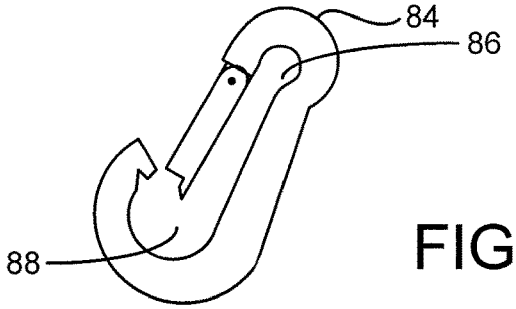
FIG. 19 shows a spring levered key ring member that is attachable to one or more rings and to the handle assembly of FIG. 18.

An alternate handle assembly is shown in FIG. 18 and designated by the numeral 70. The handle assembly 70 consists of a grip member 72 having straps 74 extending from opposite ends of the grip member 72 as shown. The strap members 74 converge to connect to opposing sides of a ring support member 76. A ring shaped eyelet member 78 has a treaded bolt shank 80 extends through a central bore of the ring support member 76 and is secured thereto by a nut 82. FIG. 19 shows a conventional key ring member 84 that has a spring loaded tab 86 that opens upon pressure to connect to the ring member 78 whereupon the body of the eyelet member 78 will reside in the hollow 88, the hollow 88 being sufficiently sized to admit entry of one or more ring members. The handle assembly 70 provides a means to rapidly connect or reconnect the grip to any ring of an exercise ring chain to shorten or lengthen the ring chain, thus selecting the strength of the ring for exercising.

Figure 20A:
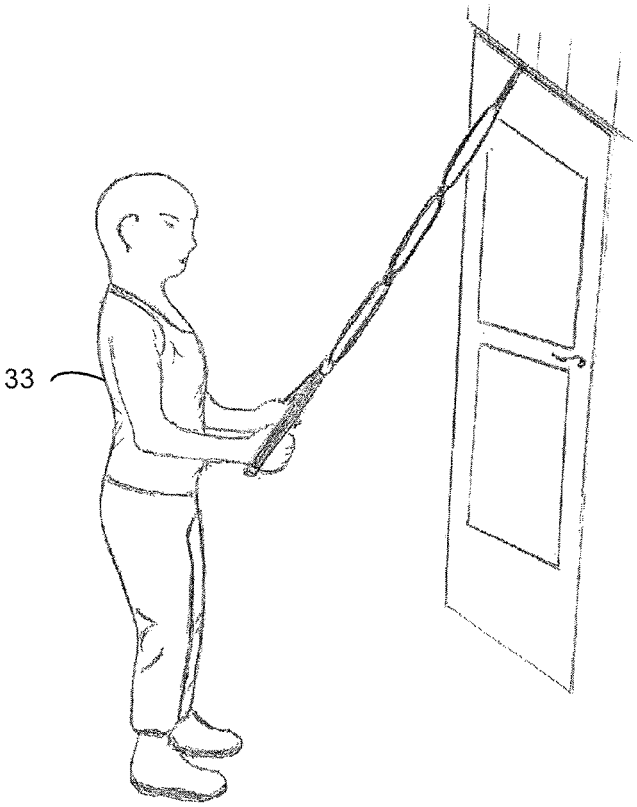
FIGS. 20A through 20H show exercises by a person using one or a pair of the stretchable power flex ring devices of the present invention.
Figure 20B:
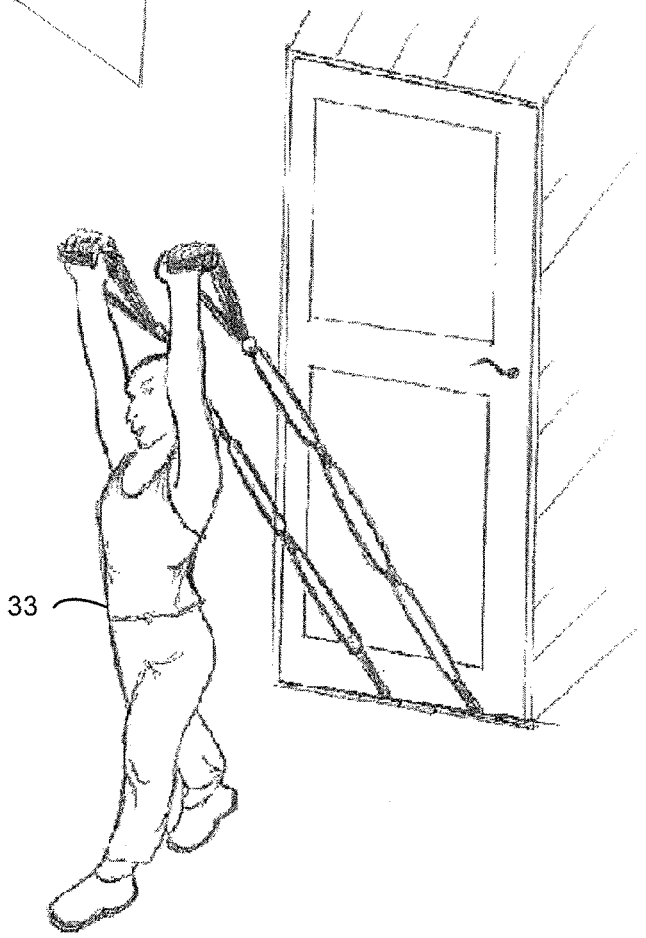
Figure 20C:
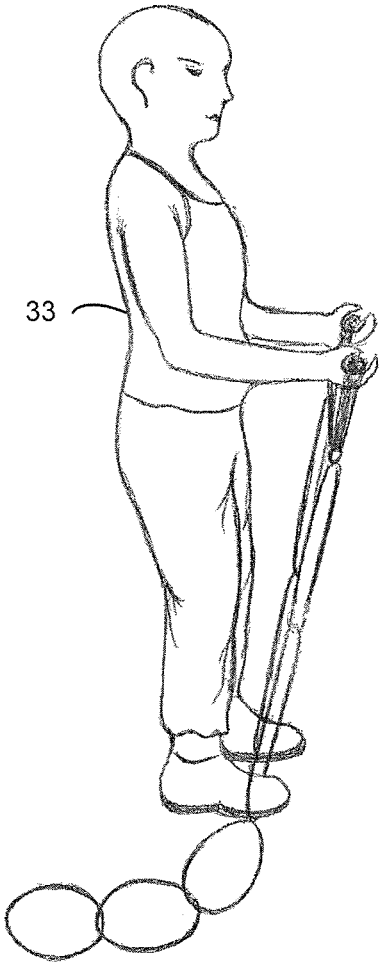
Figure 20D:
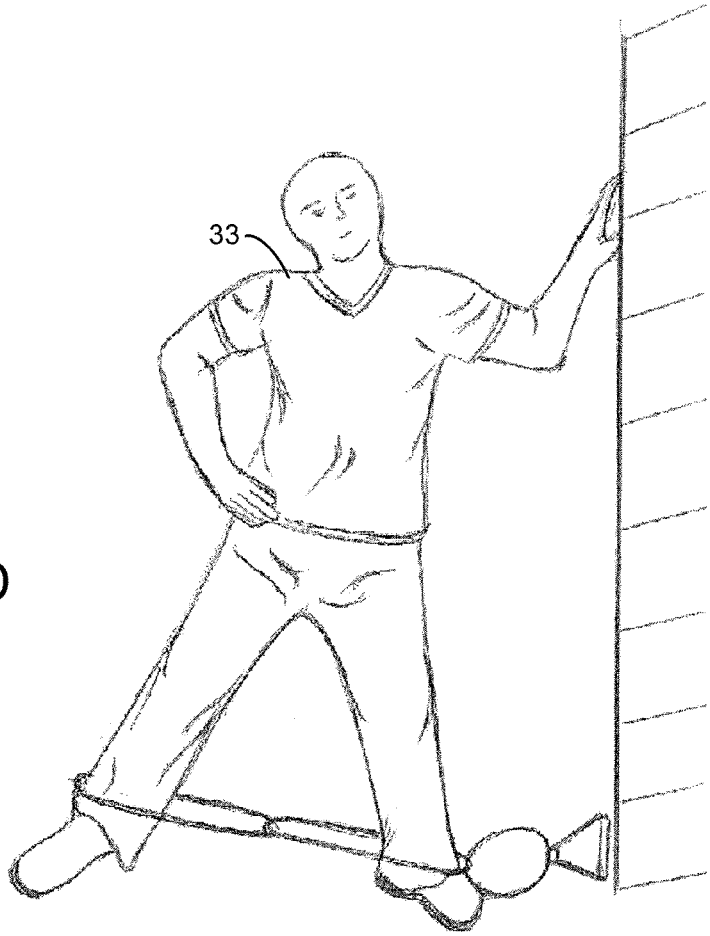
Figure 20E:
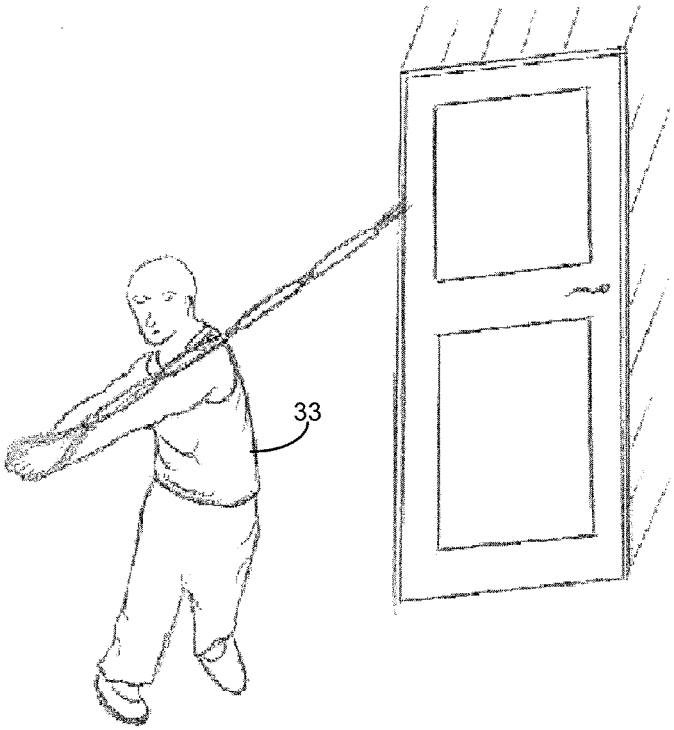
Figure 20F:
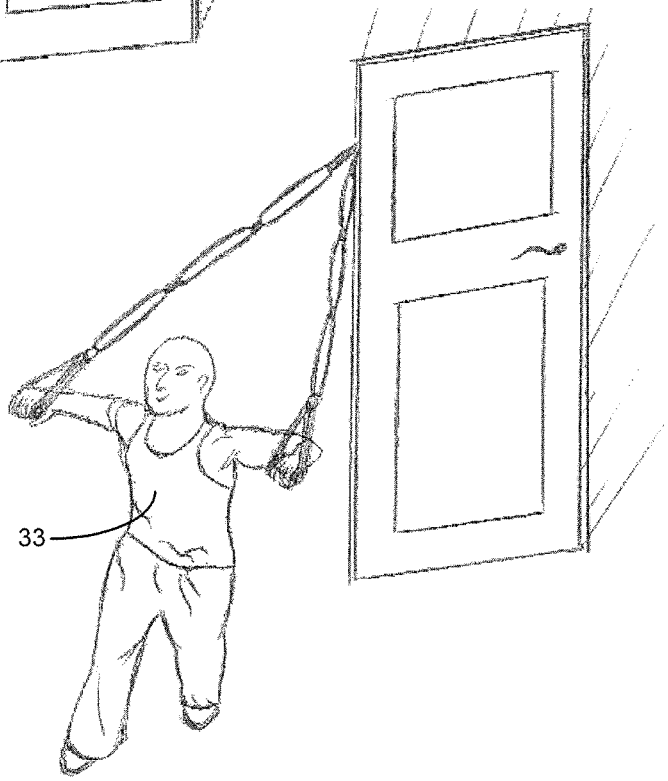
Figure 20G:
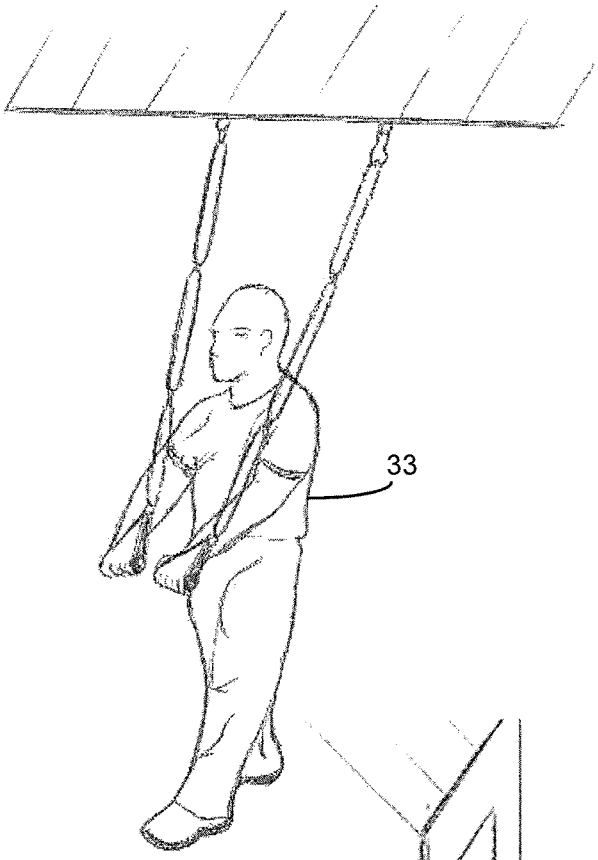
Figure 20H:
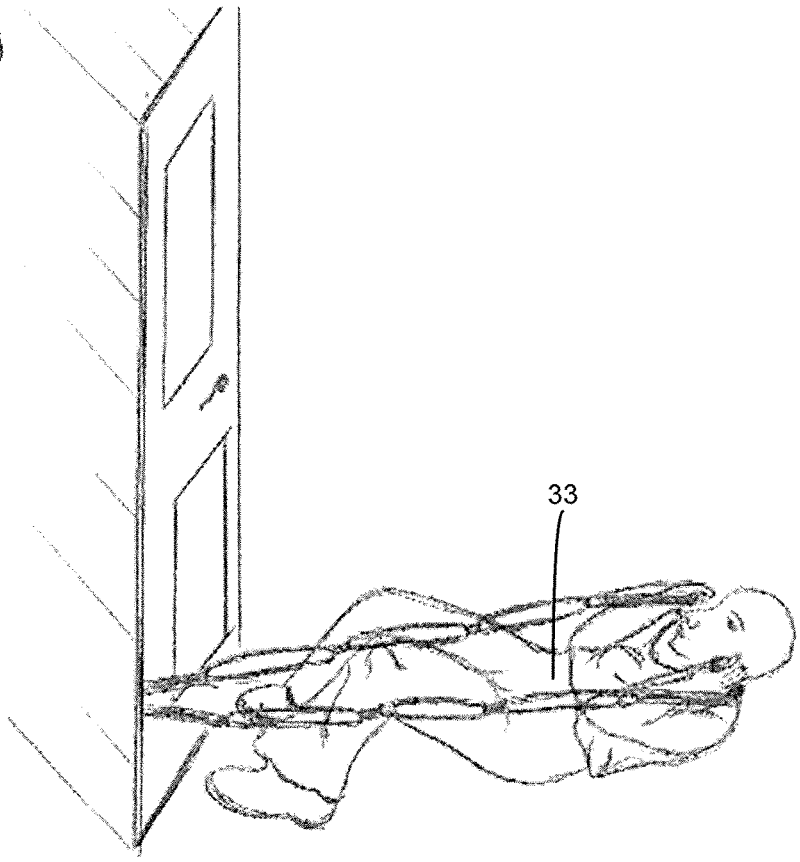

The remaining FIGS. 20A through 20H illustrate a number of exercise motions as follows:

FIG. 20A shows the person 33 performing a shoulder press and triceps press downward;

FIG. 20B illustrates a front raise and shoulder press;

FIG. 20C illustrates an arm curl from a standup (or sit down);

FIG. 20D illustrates a hip abduction for strengthening the legs;

FIG. 20E illustrates a low or high twist;

FIG. 20F illustrates a chest press;

FIG. 20G illustrates a chest and shoulder press from an overhead hook such as from an overhanging patio or the like; and FIG. 20H illustrates an abdomen or core crunch.

The above mentioned figures (FIGS. 20A-20H) show various ring combinations, with the non-used rings not shown. It will be understood that the ring chains can be adjusted without removing the non-used rings from the ring chain; that is, the versatility of attaching the handle members to any one of the rings in a chain wherein only selected ones of the rings are retained in exercise service provides the capability of the person exercising to adapt the ring chain from very difficult for the advanced exerciser to a relative easy ring chain to stretch. Thus, the power flex ring exercise system of the present invention provides a range of exercise motions not presently available to the art.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. A power flex ring exercise system comprising:

a plurality of flexible rings of variable strengths to stretch, each of the rings having the same nominal overall diameter, the same nominal cross-sectional diameter, a different resistance to deformation and a different durometer value;

a plurality of connectors interconnecting the flexible rings by pairs to form a ring chain in which each of the flexible rings is individually pivotable with respect to an immediately adjacent ring; and a handle member selectively attachable to a selected one of the flexible rings, the flexible rings configured to be paired as desirable to provide a selective range of force necessary to stretch the rings by exerting a force upon the rings using the handle member.

2. The system of claim 1 wherein the rings are made of a semi-rigid material.

3. The system of claim 2 wherein the rings have an initial shape before stretching of a donut shaped ring.

4. The system of claim 1 wherein the flexible rings are formed of latex rubber and the connectors are formed of loops of canvas strips.

5. The system of claim 1, wherein the connectors comprise flexible non-elastic loops of canvas strips that secure each ring in the ring chain to an adjacent ring to allow the ring to freely pivot with respect to the adjacent ring.

6. The system of claim 1, wherein the handle member is attached to a first ring in the ring chain, the system further comprising a securement mechanism connectable to a selected one of the remaining rings of the ring chain, the securement mechanism connecting the ring to a fixed structure to facilitate a person to perform stretching of the ring chain to perform selected exercise motions.

7. The system of claim 1, wherein each of the rings is of a different color, the color representing a different associated tensile strength of the ring.

8. The system of claim 1, further comprising a platform having a non slip medial portion and a pair of hooks, with the hooks extending from opposite ends of the platform, opposing ends of the ring chain connectable to the hooks.

9. The system of claim 6 wherein the securement mechanism comprises an anchor strap having anchor end portions, the anchor strap foldable to secure the ring chain to the fixed structure, wherein the fixed structure comprises a door frame.

10. The system of claim 1, wherein the handle member comprises:

a handle assembly having a grip member;

a ring support member supporting an eyelet member;

a pair of strap members connecting the ring support member to the grip member; and a key ring member connectable to one or more of the rings and connectable to the eyelet member.

11. A power flex ring exercise system comprising:

a plurality of rings of semi-rigid elastomeric material each ring having an initial common shape and the same nominal overall diameter, the same cross-sectional diameter, a different resistance to deformation and a different durometer value, the plurality of rings interconnected to form a chain having opposing first and second chain ends, each selected ring in the chain inter-looped with an adjacent ring in the chain so that the selected ring passes through a central aperture in the adjacent ring in non-fixed relation thereto so that the selected ring is configured to freely rotate with respect to the adjacent ring; and a user handle adapted to be connected to any selected one of the rings in the chain and grasped by a user.

12. The system of claim 11 in which each of the rings has a different selected tensile strength.

13. The system of claim 12 wherein each of the rings is of a different color, the color indicating the tensile strength of the ring.

14. The system of claim 11, wherein the rings are configured such that the rings undergo a first linear resistance response responsive to application by a user of force to the user handle to deform the rings, followed by a greater, second linear resistance response responsive to continued application by the user of force to the user handle to elongate the deformed rings.

15. The system of claim 11, further comprising a securement mechanism connectable to a selected one of the remaining rings to form a second chain end, the securement mechanism connecting the second chain end to a fixed structure to facilitate the user performing stretching of the ring chain to perform selected exercise motions.

16. The system of claim 11 further comprising a platform having a non slip medial portion and a pair of hooks, with the hooks extending from opposite ends of the platform, a pair of ring chains connectable to the hooks.

17. The system of claim 15 wherein the securement mechanism comprises an anchor strap having anchor end portions, the anchor strap foldable to secure the ring chain to the fixed structure, wherein the fixed structure comprises a door frame.

18. The system of claim 15 wherein the user handle comprises:

a handle assembly having a grip member;

a ring support member supporting an eyelet member;

a pair of strap members connecting the ring support member to the grip member; and a key ring member connectable to one or more of the rings and connectable to the eyelet member.

19. A power flex ring system comprising:

a plurality of rings of semi-rigid elastomeric material each having an initial shape, the same nominal overall diameter, a different durometer value and a different tensile strength, the plurality of rings interconnected to form a ring chain having opposing first and second chain ends, each selected ring in the chain inter-looped with an adjacent ring in the chain so that the selected ring passes through a central aperture in the adjacent ring in non-fixed relation thereto so that the selected ring is configured to freely rotate with respect to the adjacent ring;

a user handle adapted to be connected to a selected one of the rings at as the first chain end; and a securement mechanism adapted to be connected to a different, second selected one of the rings at the second chain end to secure the chain to a fixed structure, wherein the handle, the chain and the securement mechanism are structurally configured to facilitate an exercise motion by a user exerting a force via the user handle to deform the rings in the ring chain from their initial shapes.

20. The system of claim 19 wherein each of the rings is of a different color, the color indicating the tensile strength of the ring, each ring having a different associated tensile strength.

21. The system of claim 19, wherein each ring is circular in cross-sectional shape.

22. The system of claim 19, further comprising a platform having a non slip medial portion and a pair of hooks, with the hooks extending from opposite ends of the platform, a pair of the ring chains connectable to the hooks.

23. The system of claim 19, wherein the securement mechanism comprises an anchor strap having anchor end portions, the anchor strap foldable to secure the ring chain to the fixed structure, wherein the fixed structure comprises a door frame.

24. The system of claim 19 wherein the user handle comprises:

a handle assembly having a grip member;

a ring support member supporting an eyelet member;

a pair of strap members connecting the ring support member to the grip member; and a key ring member connectable to one or more of the rings and connectable to the eyelet member.

25. The system of claim 19, wherein the rings are each formed of latex rubber.

* * * * *